United States Patent [19]

Baird, Jr. et al.

[11] Patent Number: 4,719,005

[45] Date of Patent: Jan. 12, 1988

[54] CATALYTIC REFORMING PROCESS

[75] Inventors: William C. Baird, Jr.; George A. Swan, both of Baton Rouge, La.

[73] Assignee: Exxon Research and Engineering Company, Florham Park, N.J.

[21] Appl. No.: 943,736

[22] Filed: Dec. 19, 1986

Related U.S. Application Data

[63] Continuation-in-part of Ser. No. 873,589, Jun. 16, 1986, abandoned, which is a continuation of Ser. No. 782,113, Sep. 30, 1985, abandoned.

[51] Int. Cl.[4] ..... C10S 35/08

[52] U.S. Cl. ..... 208/138; 208/139

[58] Field of Search ..... 208/138

[56] References Cited

U.S. PATENT DOCUMENTS

| | | | |
|---|---|---|---|
| 3,487,009 | 12/1969 | Jacobson et al. | 208/138 |
| 3,578,583 | 5/1971 | Buss | 208/138 |
| 4,342,644 | 8/1982 | Mauldin et al. | 208/138 |

*Primary Examiner*—Curtis R. Davis

*Attorney, Agent, or Firm*—Lleuellyn A. Proctor; Henry E. Naylor

[57] ABSTRACT

Disclosed is a process for improving the octane quality of a naphtha which process comprises contacting the naphtha, at pressures ranging from about 25 psig to about 175 psig, with hydrogen introduced at a rate ranging from about 1000 SCF/B to about 5000 SCF/B, at a temperature from about 800° F. to about 1100° F., and a space velocity ranging from about 1 W/H/W to about 5 W/H/W, and with a catalyst comprised of the metals platinum, rhenium, and iridium on a refractory porous inorganic oxide support, wherein the concentration of each of platinum and rhenium is at least 0.1 percent, and that of iridium is at least 0.15 percent, and at least one of said metals is present in a concentration of at least 0.3 percent, and the sum total of said metals is present in a concentration greater than 0.9 percent.

13 Claims, No Drawings

CATALYTIC REFORMING PROCESS

CROSS REFERENCE TO RELATED APPLICATIONS

This is a continuation-in-part application of U.S. Ser. No. 873,589 filed June 16, 1986 now abandoned which is a Rule 60 Continuation of U.S. Ser. No. 782,113 filed Sept. 30, 1985, now abandoned.

BACKGROUND OF THE INVENTION

I. Field of the Invention

This invention relates to a high severity catalytic reforming process.

II. Background Description

Catalytic reforming, or hydroforming, is a well established industrial process employed by the petroleum industry for improving the octane quality of naphthas or straight run gasolines. In reforming, a multi-functional catalyst is employed which contains an acid component and a metal hydrogenation-dehydrogenation (hydrogen transfer) component, or components, substantially atomically dispersed upon the surface of a porous, inorganic oxide support, notably alumina. Noble metal catalysts, notably of the platinum type, are currently employed, reforming being defined as the total effect of the molecular changes, or hydrocarbon reactions, produced by dehydrogenation of cyclohexanes and dehydroisomerization of alkylcyclopentanes to yield aromatics; dehydrogenation of paraffins to yield olefins; dehydrocyclization of paraffins and olefins to yield aromatics; isomerization of n-paraffins; isomerization of alkylcycloparaffins to yield cyclohexanes; isomerization of substituted aromatics; and hydrocracking of paraffins which produces gas, and inevitably coke, the latter being deposited on the catalyst.

Polymetallic reforming catalysts which include platinum and one or more promotor metals are now in wide use. Reforming catalysts which contain platinum promoted with iridium (See, e.g., U.S. Pat. Nos. 2,848,377 and 3,953,368), or rhenium (See, e.g., U.S. Pat. Nos. 3,415,737 and 3,558,477), or both iridium and rhenium (See, e.g., U.S. Pat. Nos. 3,487,009; 3,507,780, and 3,578,583), composited with porous inorganic oxide supports, notably alumina, are well known. In commercial reforming operations wherein such catalysts are employed, one or a series of reactors (usually three or four) constitute the heart of the reforming unit. Each reactor is generally provided with a fixed bed, or beds, of the catalyst which receive downflow feed, and each is provided with a preheater or interstage heater, because the reactions which take place are endothermic. During the on-oil portion of an operating cycle, a naphtha feed, with hydrogen, usually recycle hydrogen gas, is cocurrently passed through a preheat furnace and reactor, and then in sequence through subsequent interstage heaters and reactors of the series. The sequences of reforming reactions take place as a continuum throughout the series of staged reactors of the reforming unit. The product from the last reactor of the series is separated into a liquid fraction, and a vaporous effluent. The former is recovered as a $C_5+$ liquid product. The latter is a gas rich in hydrogen, and usually contains small amounts of normally gaseous hydrocarbons, from which hydrogen is separated and recycled to the first reactor of the process to minimize coke production.

The activity of the catalyst gradually declines during the on-oil portion of an operating cycle due to the build-up of coke. Coke formation is believed to result from the deposition of coke precursors such as anthracene, coronene, ovalene, and other condensed ring aromatic molecules on the catalyst, these polymerizing to form coke. During operation, the temperature of the process is gradually raised to compensate for the activity loss caused by the coke deposition. Eventually, however, economics dictate the necessity of reactivating the catalyst. Consequently, in all processes of this type, the oil must be cut out and the catalyst must necessarily be periodically regenerated by burning off the coke at controlled conditions.

Regeneration, and reactivation of the catalyst is necessary. Two major types of reforming are generally practiced in the multi reactor units, both of which necessitate periodic reactivation of the catalyst, the initial sequence of which requires regeneration, i.e., burning the coke from the catalyst. Reactivation of the catalyst is completed in a sequence of steps wherein the agglomerated metal hydrogenation-dehydrogenation components are automatically redispersed. In the semi-regenerative process, a process of the first type, the entire unit is operated by gradually and progressively increasing the temperature to maintain the activity of the catalyst caused by the coke deposition, until finally oil is cut out and the entire unit is shut down for regeneration, and reactivation of the catalyst. In the second, or cyclic type of process, the reactors are individually isolated, or in effect taken off oil and swung out of line by various manifolding arrangements, motor operated valving and the like. The catalyst is regenerated to remove the coke deposits, and then reactivated while the other reactors of the series remain on oil. A "swing reactor" temporarily replaces a reactor which is removed from the series for regeneration and reactivation of the catalyst, until it is put back in series. An advantage of the cyclic operation is that higher on-oil operating severities can be employed since there is no necessity to shut down the unit for catalyst regeneration, and reactivation.

In view of environmental laws which require lead phase-down, and lead phase-out, refiners are under increasing pressure to improve the efficiency of their operations by employing better reforming technology. Higher $C_5+$ liquid yields of higher octane product are being demanded. A traditional approach by researchers and developers in meeting this objective has been to modify existing reforming catalysts, or find new catalysts designed to improve yield by suppressing metal and acid site cracking reactions. Another approach has been to reduce the unit operating pressure which, though this favors increased yield and aromatization, leads to premature catalyst deactivation due to an increased rate of coke deposition. Although to some extent coke deposition can be overcome by high hydrogen recycle rates, the combination of low pressure and high hydrogen recycle rate is, inter alia, frequently incompatible with existing equipment. Reduction in hydrogen recycle rate at low pressure, though desirable, can lead to catastrophic catalyst deactivation, especially when the unit is operated at ultra-low pressures where $C_5+$ liquid yield is optimized. For these reasons, conventional operations represent a balance, or compromise in process conditions where increased yield potential is sacrificed to maintain unit operability.

The principal barrier to successful ultra-low pressure reforming at ultra-low hydrogen rate is the lack of a catalyst capable of high activity and high stability at such harsh severity. Conventional catalysts, while initially active, deactivate at such rates that virtually all of the catalysts reforming activity is destroyed after a short time on-oil, usually about 24 to 48 hours. Thus there exists a need for new or improved catalysts which can be employed in reforming operations which can operate at ultralow pressures at ultra-low hydrogen recycle rates, while providing acceptable catalyst activity and yield stability at such conditions.

III. Objects

It is, accordingly, a primary objective of the present invention to supply this need.

A particular objective is to provide reforming process using a new, or an improved catalyst at ultra-low pressure and ultra-low hydrogen recycle rates to provide acceptable catalyst activity and $C_5$+ liquid yield stability in such reforming units.

IV. The Invention

In accordance with the present invention, there is provided a process for improving the octane quality of a naphtha which process comprises contacting the naphtha, at pressures ranging from about 25 psig to about 175 psig, with hydrogen introduced at a rate ranging from about 1000 SCF/B to about 5000 SCF/B, at a temperature from about 800° F. to about 1100° F., and a space velocity ranging from about 1 W/H/W to about 5 W/H/W, and with a catalyst comprised of the metals, platinum, rhenium, and iridium, on a refractory porous inorganic oxide support, wherein the concentration of each of platinum and rhenium is at least 0.1 percent, and that of iridium is at least 0.15 percent, and at least one of said metals is present in a concentration of at least 0.3 percent, and the sum total of said metals is present in a concentration greater than 0.9 percent.

The loadings of each of the metals, platinum and rhenium, or absolute concentration thereof, can range from not less than 0.1 to 1.2 percent, preferably from 0.1 to about 1.0 percent, and more preferably from 0.1 to about 0.7 percent, based on the total weight of the catalyst. The concentration of iridium will range from 0.15 to about 1.2 percent, preferably from 0.15 to about 1.0 percent, and more preferably from 0.15 to about 0.7 percent, based on the total weight of the catalyst.

This invention is based on the discovery that platinum, rhenium, and iridium in select concentration composited with a porous inorganic oxide support, notably alumina, will provide a catalyst of high activity and good lectivity for use in processing a naphtha at ultra-low pressure and ultra-low hydrogen recycle rates throughout an on-oil operating cycle to provide superior catalyst activity and yield stability. Representative catalysts, in terms of metals loadings (wt. %), include: 0.3 Pt-0.6 Ir-0.6 Re; 0.6 Pt-0.6 Ir-0.6 Re; 0.6 Pt-0.3 Ir-0.6 Re; 0.6 Pt-0.6 Ir-0.9 Re; 0.3 Pt-0.15 Ir-0.7 Re; and 0.3 Pt-0.3 Ir-0.6 Re, with the balance of the catalyst being constituted predominantly of the support, with additional concentrations of a halogen, and sulfur.

The catalyst is constituted of composite particles which contain, besides a carrier or support material, the platinum, rhenium, and iridium metal components, and a halide component. The support material is constituted of a porous, refractory inorganic oxide, particularly alumina. The support can contain, e.g., one or more of alumina, bentonite, clay, diatomaceous earth, zeolite, silica, activated carbon, magnesia, zirconia, thoria, and the like; though the most preferred support is alumina to which, if desired, can be added a suitable amount of other refractory carrier materials such as silica, zirconia, magnesia, titania, etc., usually in a range of about 1 to 20 percent, based on the weight of the support. A preferred support for the practice of the present invention is one having a surface area of more than 50 $m^2/g$, preferably from about 100 to about 300 $m^2/g$, a bulk density of about 0.3 to 1.0 g/ml, preferably about 0.4 to 0.8 g/ml, an average pore volume of about 0.2 to 1.1 ml/g, preferably about 0.3 to 0.8 ml/g, and an average pore diameter of about 30° to 300Å.

The metal components can be composited with or otherwise intimately associated with the porous inorganic oxide support or carrier by various techniques known to the art such as ion-exchange, coprecipitation with the alumina in the sol or gel form, and the like. For example, the catalyst composite can be formed by adding together suitable reagents such as a salt of platinum, a salt of rhenium, and a salt of iridium, and ammonium hydroxide or carbonate, and salt of aluminum such as aluminum chloride or aluminum sulfate to form aluminum hydroxide. The aluminum hydroxide containing the salts of the platinum, rhenium, and iridium metals, can then be heated, dried, formed into pellets or extruded, and then calcined in nitrogen or other nonagglomerating atmosphere. The metals components can also be added to the catalyst by impregnation, typically via an 'incipient wetness' technique which requires a minimum of solution so that the total solution is absorbed, initially or after some evaporation.

It is preferred to deposit the platinum, rhenium, and iridium pilled, pelleted, beaded, extruded, or sieved particulate support material by the impregnation method. Pursuant to the impregnation method, porous refractory inorganic oxides in dry or solvated state are contacted, either alone or admixed, or otherwise incorporated with a metal or metals-containing solution, or solutions, and thereby impregnated by either the "incipient wetness" technique, or a technique embodying absorption from a dilute or concentrated solution, or solutions, with subsequent filtration or evaporation to effect total uptake of the metallic components.

Catalyst performance is enhanced by the addition of a halogen component. Fluorine and chlorine, particularly the latter, are preferred halogen components. During normal catalyst preparation, the halogen is applied to the catalyst in concentration ranging from about 0.1 to 3 percent, preferably from about 0.3 to 2 percent, based on the weight of the catalyst. When using chlorine as a halogen component, it is applied to the catalyst in concentration ranging from about 0.2 to 2 percent, preferably from about 0.8 to 1.3 percent based on the weight of the catalyst. The introduction of halogen into the catalyst, during catalyst preparation, can be carried out by any method and at any time of the catalyst preparation, for example, prior to, following, or simultaneously with the impregnation of the platinum, iridium, and rhenium components. In the usual operation, the halogen component is introduced simultaneously with the incorporation of the platinum metal component. It can also be introduced by contacting a carrier material in a vapor phase or liquid phase, e.g., as with a solution of a halogen compound such as hydrogen fluoride, hydrogen chloride, ammonium chloride, or the like. After regeneration of the catalyst, halogen is again added to bring the halide content of the catalyst back to its original concentration, since some of the halogen is usually leached off, and lost during the on-oil reforming operation. The halogen can be applied to the catalyst by contact of the catalyst with a vapor phase or liquid phase material containing the desired halogen in the required concentrations, e.g., by impregnation of the catalyst with a halogen-containing liquid to impregnate the halogen into the catalyst.

The catalyst can be dried by heating at a temperature above about 200° F., preferably between about 500° F. and 750° F., in the presence of nitrogen or oxygen, or both, in an air stream or under vacuum. The catalyst is calcined at temperatures in excess of 500° F., preferably at temperatures ranging from about 500° F. to about 750° F., in air or in atmospheres containing low partial pressures of oxygen or in a nonreactive or inert gas such as nitrogen.

A platinum-iridium-rhenium catalyst such as characterized, is then contacted with hydrogen, suitably a dry hydrogen-containing gas, at a temperature ranging from about 600° F. to about 1000° F., preferably from about 750° F. to about 950° F., at a hydrogen partial pressure ranging from about 1 atmosphere to about 40 atmospheres, preferably from about 5 atmospheres to about 30 atmospheres. Preferably, the flow rate of the gas is sufficient to maintain the moisture level below about 500 parts, preferably from about 0 parts to about 200 parts, and more preferably from about 10 parts to about 200 parts per million parts by volume of gas in the exit gas stream. The contact between the hydrogen and catalyst is continued for a period of time ranging at least about 16 hours, preferably at least 16 hours to about 200 hours, and more preferably from about 16 hours to about 48 hours.

Sulfur is a highly preferred component of the catalysts, the sulfur content of the catalyst generally ranging to about 0.2 percent, preferably from about 0.05 to about 0.2 percent, and more preferably from about 0.05 percent to about 0.15 percent, based on the weight of the catalyst (dry basis). The sulfur can be added to the catalyst by conventional methods, suitably by breakthrough sulfiding of a bed of the catalyst with a sulfur-containing gaseous stream, e.g., hydrogen sulfide in hydrogen, performed at temperatures ranging from about 750° F. to about 950° F. and at pressures ranging from about 1 to about 40 atmospheres for the time necessary to achieve breakthrough, or the desired sulfur level.

The feed or charge stock contacted with the reduced, sulfided catalyst can be a virgin naphtha, cracked naphtha, a Fischer-Tropsch naphtha, or the like. Typical feeds are those hydrocarbons containing from about 5 to about 12 carbon atoms, or more preferably from about 6 to about 9 carbon atoms. Naphthas, or petroleum fractions boiling within the range of from about 80° F. to about 450° F., and preferably from about 125° F. to about 375° F., contain hydrocarbons of carbon numbers within these ranges. Typical fractions thus usually contain from about 20 to about 80 vol. % paraffins, both normal and branched, which fall in the range of about $C_5$ to $C_{12}$, from about 10 to 80 vol. % of naphthenes falling within the range of from about $C_6$ to $C_{12}$, and from 5 though 20 vol. % of the desirable aromatics falling within the range of from about $C_6$ to $C_{12}$.

The invention will be more fully understood by reference to the following demonstrations and examples which present comparative data illustrating its more salient features. All units are in terms of weight except as otherwise specified.

EXAMPLES

A light Arabian paraffinic naphtha feed was employed in a series of tests. Inspections on the feed used in these tests are given in Table I.

TABLE I

| | |
|---|---|
| API Gravity | 59.7 |
| Sulfur, ppm (Wt.) | <0.1 |
| Nitrogen, ppm (Wt.) | <0.1 |
| ASTM Distillation | |
| IBP | 181 |
| 5 | 196 |
| 10 | 204 |
| 20 | 211 |
| 30 | 218 |
| 40 | 229 |
| 50 | 241 |
| 60 | 253 |
| 70 | 269 |
| 80 | 287 |
| 90 | 310 |
| 95 | 328 |
| Dry | 350 |

In a first series of tests, a commercially prepared Pt/Re catalyst (0.3% Pt/0.3% Re) was calcined at 932° F. for 3 hours, reduced with hydrogen for 17 hours at the same temperature, and then sulfided at similar temperature. Separate charges of this catalyst were then employed in a series of runs in a pilot plant unit to reform said paraffinic naphtha feed at 950° F. (E.I.T.), 1.9 W/H/W, 100 RON, over a 100 hour on-oil period. Reference is made to Table II wherein it will be observed that in Run 1 the run was made at high pressure cyclic severity (275 psig/3000 SCF/B), in Run 2 the run was made at low pressure cyclic severity (175 psig/3000 SCF/B), in Run 3 the run was made at low pressure cyclic severity at high hydrogen recycle rate (100 psig/5000 SCF/B), in Run 4 the run was made at low pressure ultra-high hydrogen recycle rate (100 psig/10,000 SCF/B), and in Run 5 low pressure and low recycle rate (150 psig/1500 SCF/B) were employed.

TABLE II

Cyclic Reforming of Paraffinic Naphtha With Pt—Re Catalyst (950° F. EIT, 1.9 W/H/W, 100 RON)

| Run No. | psig | SCF/B | psia Oil | psia $H_2$ | Activity | $C_5$+ LV % at 100 RON |
|---|---|---|---|---|---|---|
| 1 | 275 | 3000 | 53 | 172 | 69 | 70.3 |
| 2 | 175 | 3000 | 43 | 112 | 66 | 75.2 |
| 3 | 100 | 5000 | 19 | 80 | 68 | 76.6 |
| 4 | 100 | 10000 | 10 | 89 | 136 | 79.7 |
| 5 | 160 | 1500 | 61 | 82 | 30 | 70.5 |

Simple pressure reduction accounts for the yield improvement demonstrated in Runs 1 and 2. Further yield improvement is possible by further pressure reduction as demonstrated by Run 3, if activity is maintained by increasing recycle rate. Run 4 shows that yield is maximized by combining low pressure with ultra-high recycle rate. The conditions of runs 3 and 4 are, however, not adaptable to existing process equipment. Run 5 pressure remains at conventional levels, but recycle rate is significantly reduced. Rapid deactivation results as reflected in the low activity value and the loss of yield credits. These data show that yield is favored by low operating pressure, which provides a low hydrogen pressure; activity is a function of oil pressure which is determined by recycle rate at a given operating pressure. The most deactivating environment as shown by these data is generated by the combination of low hydrogen pressure with relatively high oil pressure.

An additional series of runs (Runs 6–9) were conducted employing a different Pt/Re catalyst, and bimetallic catalysts other than Pt/Re, to wit: Pt/Sn and Pt/Ir catalysts. Thus, a Pt/Re catalyst (0.3% Pt/0.7% Re) was calcined, reduced and sulfided as were the previously described Pt/Re catalyst employed in Runs 1–5. This catalyst is especially resistant to deactivation at conditions not tolerated by other conventional catalysts. The catalyst was used to reform a Light Arab paraffinic naphtha at 50 psig and 2200 SCF/B. The results are given as Run 6 in Table III with the other conditions of operation. It is seen that rapid and nearly total deactivation of the catalyst occurred. The catalyst was essentially inactive after 48 hr. on oil; yield stability was consequently poor with an initially high value decaying to a low level with time.

A Pt/Sn (0.3 Pt-0.3 Sn) and a Pt/Re/Sn (0.3 Pt-0.7 Re-0.3 Sn) catalyst were calcined, reduced and sulfided as were the Pt/Re catalysts employed in conducting Runs 1–6, and used to reform the same naphtha at the conditions described with reference to Runs 1–6. These Sn-containing catalysts also experienced rapid loss of activity and yield stability as is evident from the results given in Table III, as Runs 7 and 8, respectively.

A 0.3 Pt-0.3 Ir catalyst was air calcined at 750° F. and reduced and sulfided as were the Pt/Re catalysts employed in conducting Runs 1–6. The catalyst was used to reform said paraffinic naphtha at the conditions described with reference to Runs 1–6. The catalyst, as shown in Table III (Run 9), performed poorly due to rapid deactivation.

TABLE III

Reforming of A Paraffinic Naphtha at Ultra-Low Pressure and Ultra-Low Recycle Cyclic Conditions 950° F. EIT, 50 psig, 2200 SCF/B, 2.3 W/H/W, 100 RON (47 psia Hydrogen, 18 psia Oil)

| Run No. | Catalyst | Activity at Hr. 50 | Activity at Hr. 100 | $C_5$+ LV % at Hr. 50 | $C_5$+ LV % at Hr. 100 |
|---|---|---|---|---|---|
| 6 | 0.3 Pt—0.7 Re | 31 | 10 | 76.7 | 71.4 |
| 7 | 0.3 Pt—0.3 Sn | 45 | 11 | 80.2 | 72.9 |
| 8 | 0.3 Pt—0.7 Re—0.3 Sn | 39 | 11 | 78.0 | 73.3 |
| 9 | 0.3 Pt—0.3 Ir | 40 | 19 | 75.0 | 73.0 |
| 10 | 0.3 Pt—0.3 Ir—0.3 Re | 57 | 18 | 77.9 | 74.0 |
| 11 | 0.3 Pt—0.15 Ir—0.7 Re | 80 | 37 | 79.6 | 77.7 |
| 12 | 0.3 Pt—0.3 Ir—0.7 Re | 75 | 29 | 78.3 | 76.0 |
| 13 | 0.6 Pt—0.6 Ir—0.6 Re | 107 | 57 | 79.9 | 78.4 |
| 14 | 0.6 Pt—0.1 Ir—0.6 Re | 40 | 11 | 78.9 | 72.6 |
| 15 | 0.6 Pt—0.3 Ir—0.6 Re | 86 | 38 | 79.8 | 78.4 |
| 16 | 0.6 Pt—0.6 Ir—0.6 Re | 140 | 102 | 78.1 | 79.2 |

A series of Pt/Ir/Re catalysts was prepared, pretreated as previously described and then used to reform said paraffinic naphtha feed with the results given in Table III. For Run 10, a catalyst not of this invention, a 0.3% Pt-0.3% Ir-0.3% Re catalyst was employed. The data illustrate rapid deactivation and loss of yield stability for this trimetallic although the performance was marginally superior to the catalysts employed in Runs 6–9.

Run 11. A 0.3 Pt-0.15 Ir-0.7 Re catalyst was pretreated as in Run 9 and used to reform a paraffinic naphtha as in Run 6. As shown in Table III, this trimetallic catalyst displayed good activity, stability, and yield stability relative to other catalysts of Table III.

Run 12. A 0.3 Pt-0.3 Ir-0.7 Re catalyst was pretreated as in Run 9 and used to reform a paraffinic naphtha as in Run 6. Table III shows that this trimetallic catalysts was also superior to other catalysts at these low pressure, low recycle conditions.

Run 13. A 0.6 Pt-0.6 Ir-0.6 Re catalyst was treated as in Run 9 and used to reform a paraffinic naphtha as in Run 6. This catalyst had excellent on oil activity and yields as is seen in Table III.

Run 14. A 0.6 Pt-0.1 Ir-0.6 Re catalyst was pretreated as in Run 9 and used to reform a paraffinic naphtha as in Run 6. The catalyst had poor activity, stability, and yield as shown in the table.

Run 15. A 0.6 Pt-0.3 Ir-0.6 Re catalyst was pretreated as in Run 9 and used to reform a paraffinic naphtha as in Run 6. The catalyst had good activity and yield as the table indicates.

Run 16. A 0.6 Pt-0.6 Ir-0.9 Re catalyst was pretreated and employed in naphtha reforming as in Runs 6 and 9, respectively. The catalyst had excellent activity, stability and yield as the table shows.

The data of Table III clearly show major activity and yield credits for the trimetallic catalysts of this invention over other catalyst systems. The process of Run 11–16 utilizing the trimetallic catalysts at low pressure and low recycle offers major benefits over those of Runs 1 and 2, which represent conventional technology currently in use. Unlike the low pressure, high recycle conditions of Runs 3 and 4, which are not compatible with existing units, the conditions of Table III are adaptable to existing equipment. Thus, the trimetallic catalysts of this invention permit a major process advantage not captured by conventional catalysts.

It is apparent that various modifications and changes can be made in the process, and compositions without departing the spirit and scope of the invention.

What is claimed is:

1. A process for improving the octane quality of a naphtha which process comprises contacting the naptha, at pressures ranging from about 25 psig to about 175 psig, with hydrogen introduced at a rate ranging from about 1000 SCF/B to about 5000 SCF/B, at a temperature from about 800° F. to about 1100° F., and a space velocity ranging from about 1 W/H/W to about 5 W/H/W, and with a catalyst comprised of the metals platinum, rhenium, and iridium on a refractory porous inorganic oxide support, wherein the concentration of each of platinum and rhenium is at least 0.1 percent to about 1.2 percent, and that of iridium is at least 0.15 percent to about 1.2 percent, and at lest one of said metals is present in a concentration of at least 0.3 percent, and the sum total of said metals is present in a concentration greater than 0.9 percent.

2. The process of claim 1 wherein the pressure ranges from about 35 psig to about 125 psig.

3. The process of claim 1 wherein the pressure ranges from about 50 psig to about 100 psig.

4. The process of claim 1 wherein the hydrogen rate ranges from about 1500 SCF/B to about 4000 SCF/B.

5. The process of claim 1 wherein the hydrogen rate ranges from about 2000 SCF/B to about 3500 SCF/B.

6. The process of claim 1 wherein the pressure ranges from about 35 psig to about 125 psig and the hydrogen rate ranges from about 1500 SCF/B to about 4000 SCF/B.

7. The process of claim 1 wherein the pressure ranges from about 50 psig to about 100 psig and the hydrogen rate ranges from about 2000 SCF/B to about 3500 SCF/B.

8. The process of claim 1 wherein the catalyst contains from about 0.1 percent to about 1.0 percent platinum.

9. The process of claim 1 wherein the catalyst contains from about 0.1 percent to about 0.7 percent platinum.

10. The process of claim 1 wherein the catalyst contains from about 0.1 percent to about 1.0 percent rhenium.

11. The process of claim 1 wherein the catalyst contains from about 0.1 percent to about 0.7 percent rhenium.

12. The process of claim 1 wherein the catalyst contains from about 0.15 percent to about 1.0 percent iridium.

13. The process of claim 1 wherein the catalyst contains from about 0.15 percent to about 0.7 percent iridium.

* * * * *